US005275454A

United States Patent [19]

Deardorff

[11] Patent Number: 5,275,454

[45] Date of Patent: Jan. 4, 1994

[54] TWIG FURNITURE

[75] Inventor: James C. Deardorff, Reedsport, Oreg.

[73] Assignee: Out of the Woods Furniture Co., Reedsport, Oreg.

[21] Appl. No.: 765,922

[22] Filed: Sep. 24, 1991

[51] Int. Cl.[5] ..... A47C 5/00; A47C 3/029

[52] U.S. Cl. ..... 297/446; 297/258; 297/232

[58] Field of Search ..... 297/258, 270–272, 446, D6/348, 351, 370

[56] References Cited

U.S. PATENT DOCUMENTS

| | | | |
|---|---|---|---|
| 7,539 | 7/1850 | Warren | 297/232 |
| D. 90,491 | 8/1933 | Leonard et al. | D6/370 |
| 458,808 | 9/1891 | Judd | 297/466 |
| 1,674,375 | 6/1928 | Patton | 297/445 X |
| 4,509,794 | 4/1985 | Roland | 297/440 |

OTHER PUBLICATIONS

Masterworks Catalog Section, 1986.

*Pacific Willow Catalog* (Oregon, undated), 2 pages.

"Haven in the Berkshires," *Country Living* (Jul. 1984), 1 page.

"Bent Willow Rocker," Pure and Simple Christmas 1989 Catalog, Nashville, Ark., p. 31, item C.

Appendix C from an unknown and undated furniture catalog, illustrating prior art "peeled bark" furniture, p. 27.

*Rocky Mountain Timber Products 1989 Catalog* (Sisters, Oreg.), cover and 2 pages.

"LoDo," *Sunset Magazine* (Nov. 1990), pp. 28–29, and an enlargement of the photograph at the bottom of p. 29.

Adirondack Bentwood Rocker, *L. L. Bean Fall 1991 Weekend Specialties Catalog*, p. 75.

Mack, Daniel, "Wild and Woody," *Mother Earth News*, No. 103 (Jan./Feb. 1987) cover and pp. 42–47.

Webster, Bryce, "A Rustic Renaissance–Twig Furniture," *WD Specials* (Jun. 1985), pp. 72–77 (pp. 72 and 73 interposed for ease of identification.).

*Country Store Catalog*, Whitefish Bay, Wisc. (1987) 10 pages.

"Bent Willow Rocker," *Pure and Simple Christmas 1989 Catalog*, Nashville, Ark., p. 31, item C.

Appendix A comprises 3 pages illustrating various prior art twig furniture pieces.

Appendix B comprises 2 pages of a prior art article "As the Twig is Bent," pp. 59 and 60.

*Primary Examiner*—Peter R. Brown

*Attorney, Agent, or Firm*—Klarquist Sparkman Campbell Leigh & Whinston

[57] ABSTRACT

An article of twig furniture, such as a rocker, a loveseat, a chair or a loveseat rocker, is a composite of finished wood and natural wood twigs retaining at least a portion of their natural bark outer layer. A solid seat of finished wood is supported by a pair of twig front legs which extend upwardly to form a pair of arm support columns. A pair of forked twig rear legs extend upwardly from the seat to form a pair of back support columns to which are attached a plurality of finished wood slats. A single forked tree twig forms each rear leg and back support column. The smaller limb or branch of the rear leg fork extends rearwardly of the larger portion of the fork to provide a secure support for the seat.

14 Claims, 5 Drawing Sheets

20
50
56
52
44b
44a
60b
60a
40b
54
34b
30b
34a
22
24
28b
25
26
30a
40a
32a
58
36b
28a
42a
39
38
46b
45b
49
70b
48a
39
36a
45a
46a
72a
74a
70a
76a 190
195b
195a
156
192
100
144b
196b
160b
140b
144a
196a
134b
160a
128b
130b
194
134a
180
185b
198b
182a
184
130a
182b
136b
185a
170b
140a
198a
138
132a
128a
142a
149
148a
139
136a
146a
145a
172a
174a
170a
176a

TWIG FURNITURE

BACKGROUND OF THE INVENTION

The present invention relates generally to furniture, and more particularly to furniture which is a composite of a branched or forked tree member and other finished wood members fashioned to form a structurally strong and aesthetically pleasing article of furniture.

Many articles of furniture, including chairs, loveseats, rockers, coffee tables, end tables, kitchen tables, and beds have been made from a combination of natural materials by our pioneer forefathers, and more recently by contemporary artists in response to a renewed interest in this rustic type of furniture as a utilitarian art form. Some of the more recent designs are often referred to as "twig furniture," with the term "twig" used broadly to encompass varying sizes of tree branches and trunk members which generally retain their bark in the finished furniture.

The contemporary designs include furniture constructed totally of twigs, such as: straight twigs of burled lodge pole pine, maple and juniper; bent twigs of willow, maple and hickory; and combinations of straight and bent twigs. In combination with these various types of twigs, other natural materials are also used in these contemporary furniture designs, including oak slats, cotton Shaker tape, leather and rawhide.

Many of these items of furniture, and particularly the chairs, require a multitude of twig pieces for bracing and supporting the chair legs to provide a chair which is strong enough to support a person. Such chairs are costly and time consuming to manufacture due to the multitude of pieces required. Many of the techniques used to construct twig furniture include the use of green unseasoned twigs, which upon seasoning often shrink, twist and crack, detracting from the structural integrity of the chair.

Thus, a need exists for an improved article of twig furniture, which is directed toward overcoming, and not susceptible to, the above limitations and disadvantages.

SUMMARY OF THE INVENTION

An article of twig furniture, such as a rocker, a loveseat, a chair and a loveseat rocker, is a composite of finished wood and natural wood twigs retaining at least a portion of their natural bark outer layer. A solid seat of finished wood has a pair of twig front legs which extend upwardly to form a pair of arm support columns. A pair of forked twig rear legs extend upwardly from the seat to form a pair of back support columns to which are attached a plurality of finished wood slats. A single forked tree twig forms each rear leg. The smaller limb of the rear leg fork extends rearwardly of the larger portion of the fork to provide a secure support for the seat.

An overall object of the present invention is to provide an improved article of twig furniture, and more particularly an improved composite article of furniture comprising twig and finished wood components.

A further object of the present invention is to provide an improved structural support for an article of twig furniture.

Still another object of the present invention is to provide a composite twig and finished wood article of furniture which is both aesthetically pleasing and comfortable.

Yet another object of the present invention is to provide an improved article of twig furniture constructed from a minimum number of parts and which has an enhanced structural integrity over earlier designs.

The present invention relates to the above features and objects individually as well as collectively. These and other objects, features and advantages of the present invention will become apparent to those skilled in the art from the following description and drawings.

DETAILED DESCRIPTION OF THE PREFERRED EMBODIMENTS

Figure 1:
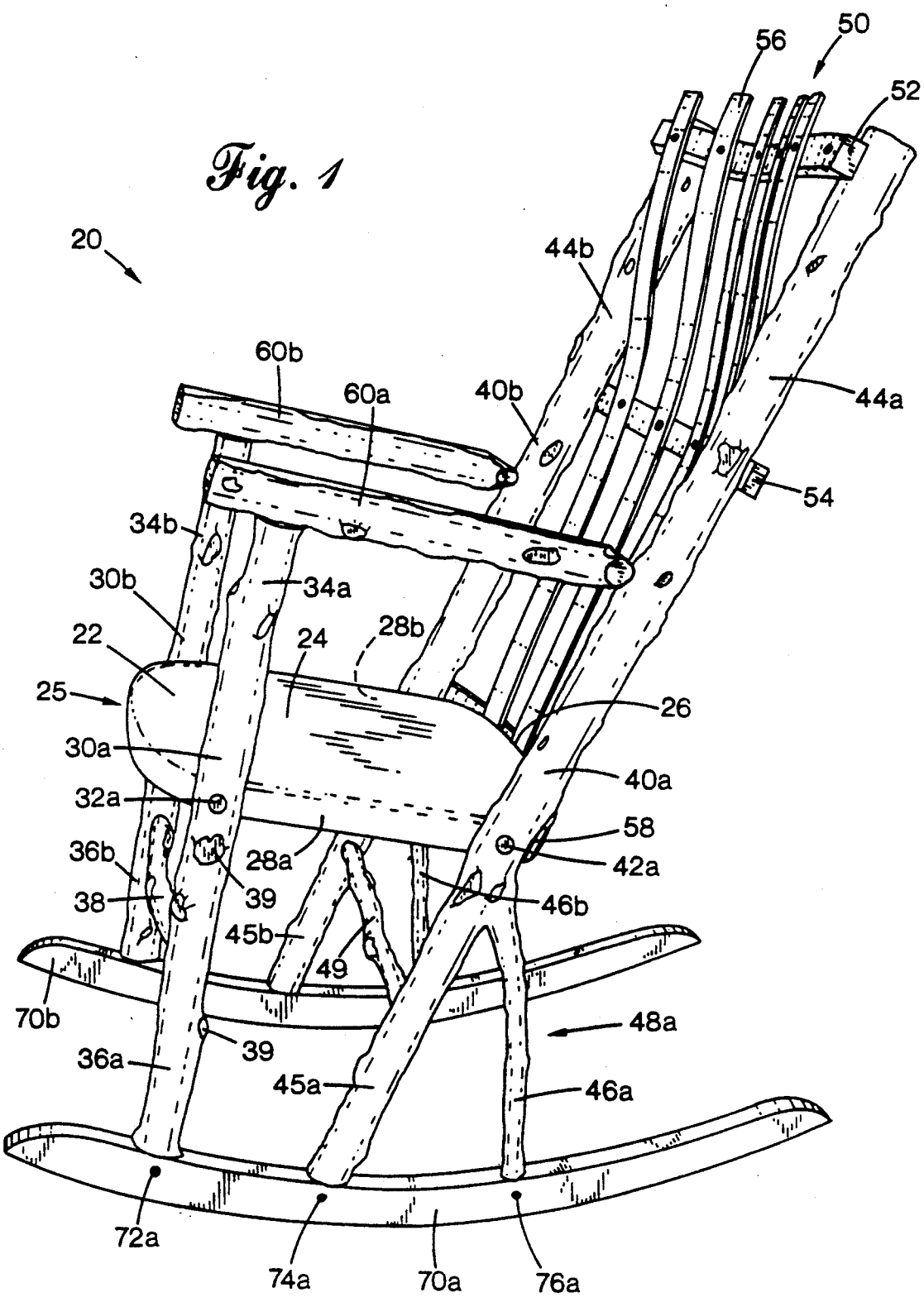
FIG. 1 is a perspective view of one form of an article of twig furniture of the present invention comprising a rocking chair or rocker.
Figure 4:
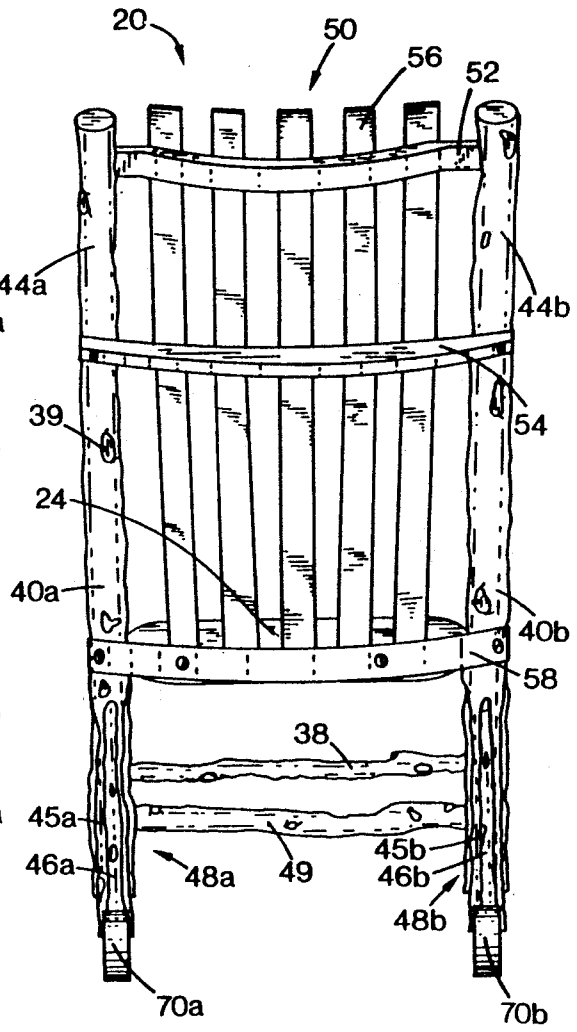
FIG. 4 is a rear elevational view of the rocker of FIG. 1.
Figure 3:
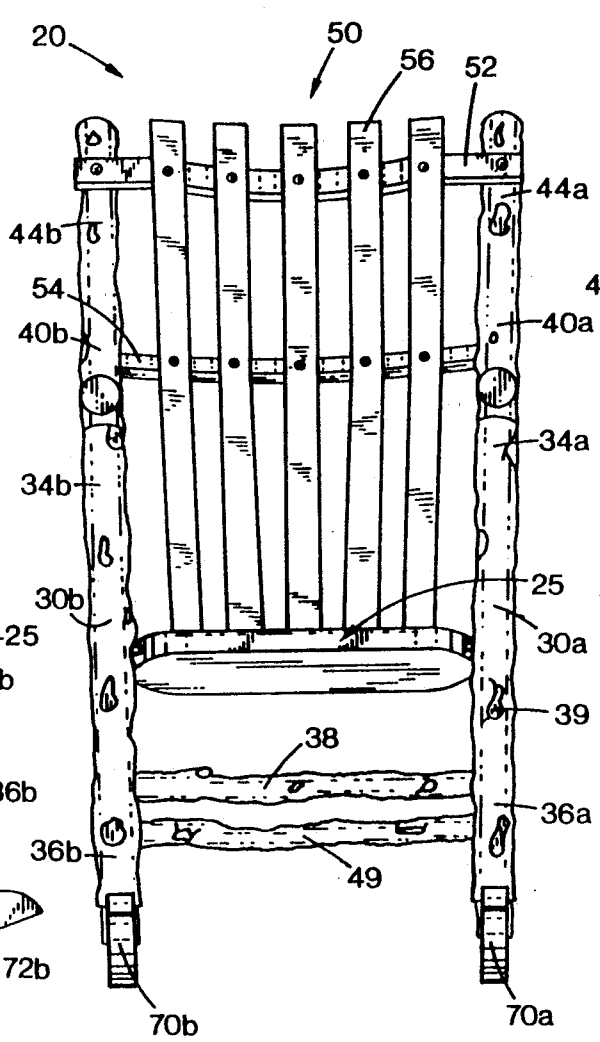
FIG. 3 is a elevational view of the rocker of FIG. 1.

FIGS. 1–4 illustrate an embodiment of an article of twig furniture of the present invention comprising a chair, which may be configured as a rocking chair or rocker 20. The rocker 20 has a seat member or seat 22 which is preferably of a solid piece of finished wood having smoothed surfaces, and which is preferably of alder. The seat 22 has an upper surface 24 for sitting upon, which may be a smooth surface as shown, or a contoured surface. The seat 20 also has a front portion 25 which may include curved or rounded edges and corners as desired. The seat 20 also has a rear wall 26 which preferably has a convex curvature. A pair of side walls **28*a* and 28*b* extend between the front portion 25 and the rear wall 26 of seat 20**.

The letters "a" and "b" are used herein in conjunction with the item numbers to designate like components on each side of an article of furniture. The letter "a" designates components on the right side when the article of twig furniture is viewed from the front, and the letter "b" designates components on the left side. When describing features common to the pair of components on both sides of the furniture article, only the item number is used, as it is apparent to one skilled in the art that each item of a pair of components may be mirror images of one another structurally. Of course, the unique variations and characteristics obtainable through the use of twigs as described below always provides an original and unique article of furniture.

Figure 2:
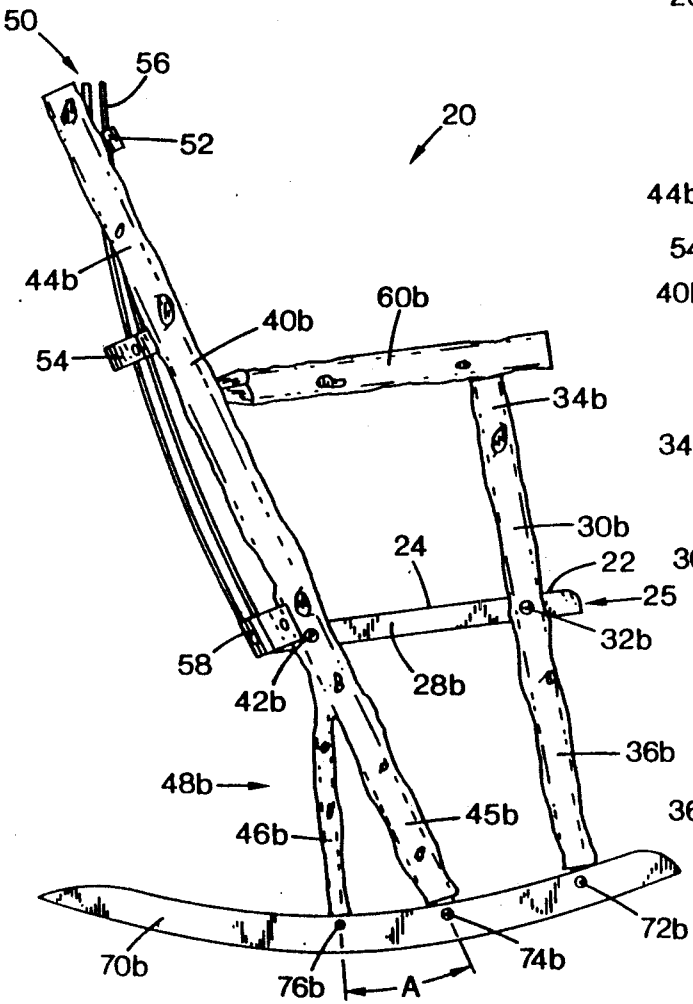
FIG. 2 is a left elevational view of the rocker of FIG. 1.
Figure 5:
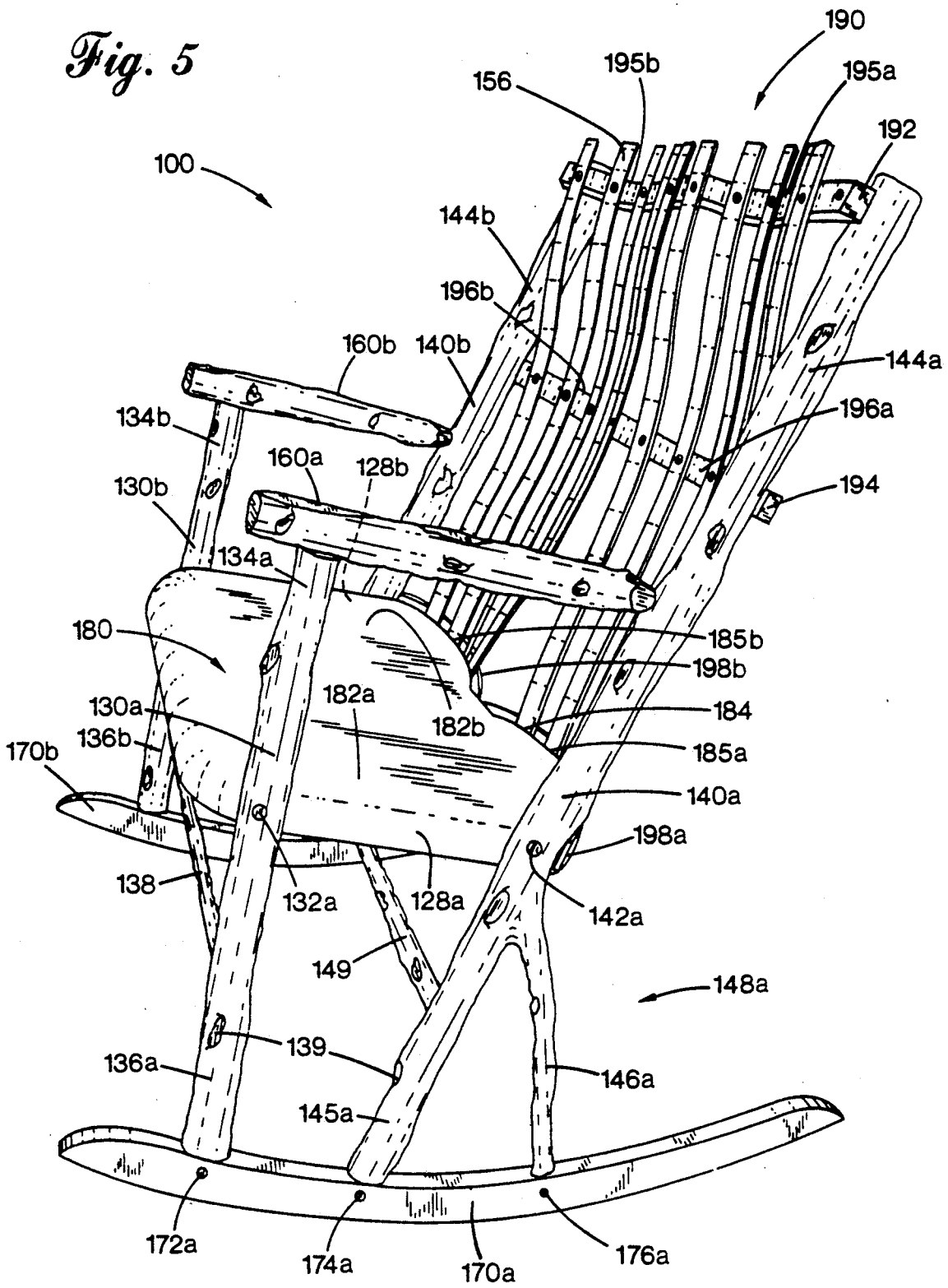
FIG. 5 is a perspective view of another form of an article of twig furniture of the present invention comprising a loveseat rocker.
Figure 7:
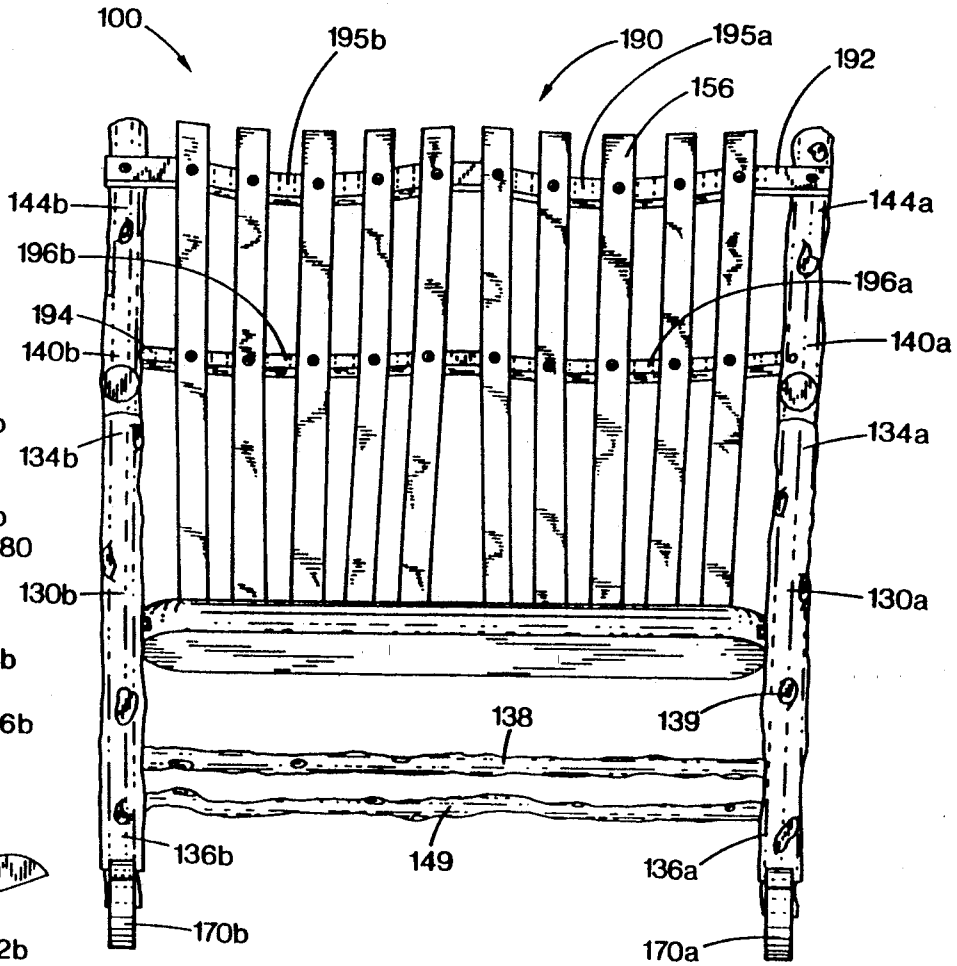
FIG. 7 is a front elevational view of the loveseat rocker of FIG. 5.
Figure 6:
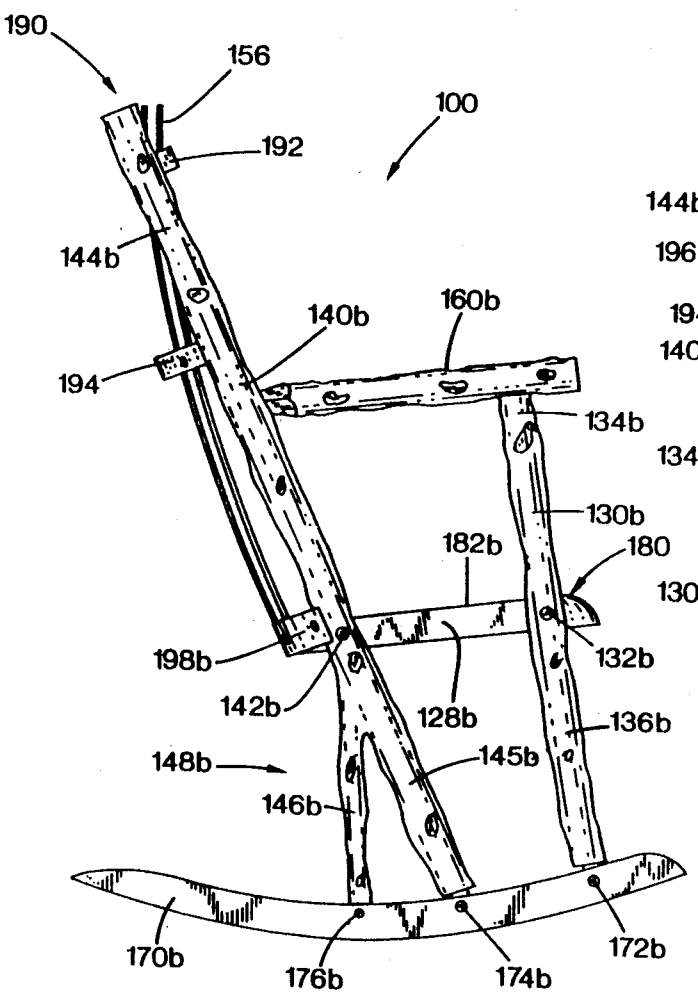
FIG. 6 is a left elevational view of the loveseat rocker of FIG. 5.
Figure 8:
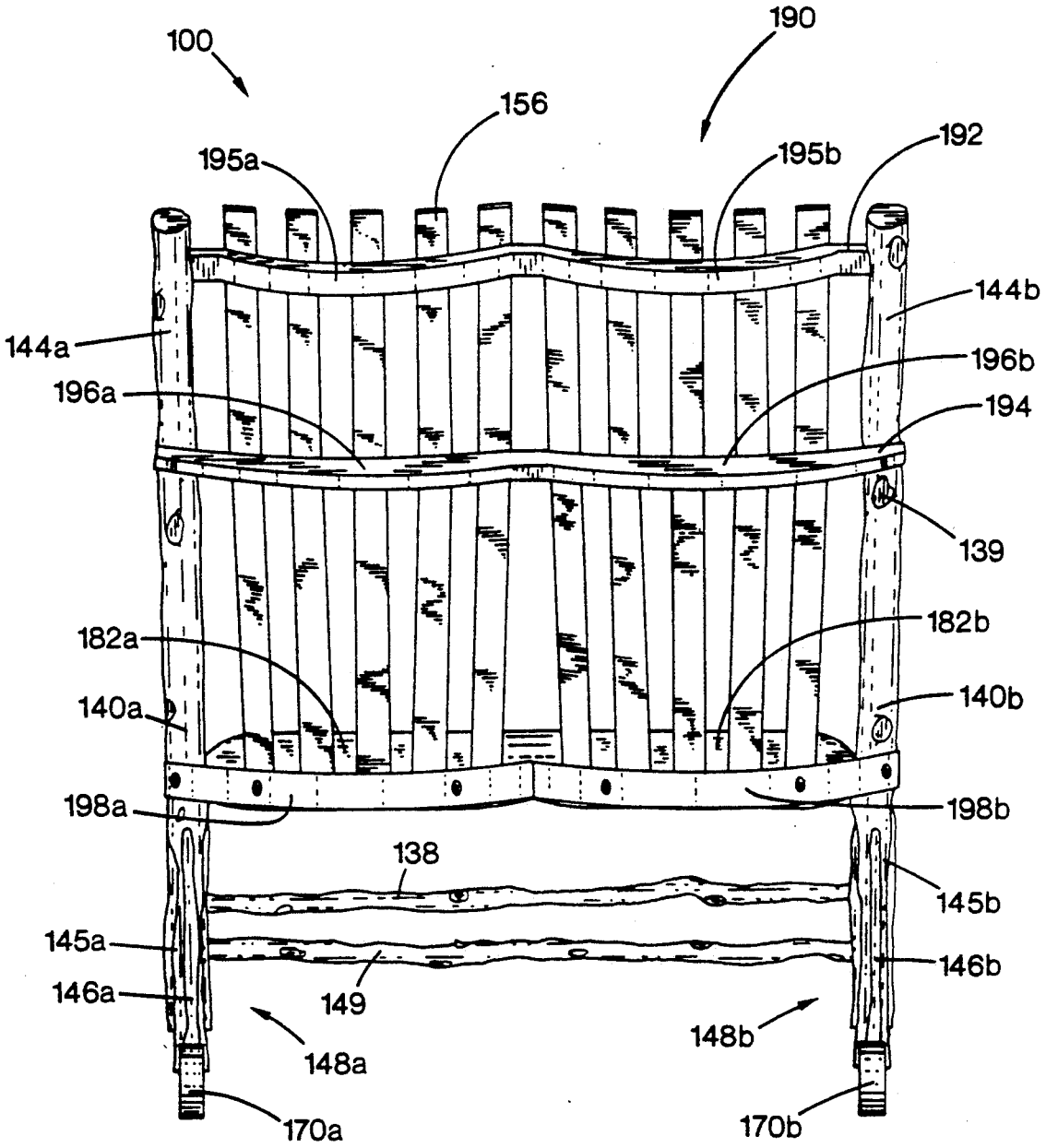
FIG. 8 is a rear elevational view of the loveseat rocker of FIG. 5.

A pair of front support member or front supports **30*a* and 30*b* are mounted to the respective side walls 28*a* and 28*b* of seat 22 adjacent the front portion 25, for example, by a pair of wooden dowels 32*a* and 32*b* which may also be of alder (see FIGS. 1 and 2). The front supports 30*a* and 30*b* are made from tree members or twigs, which are preferably of alder. Each of the front supports 30***a* and 30*b* extend upwardly from the seat 22 to form a pair of arm support columns 34*a* and 34*b*, respectively. The front supports 30*a* and 30*b* also extend downwardly from the seat 22 to form a pair of front legs 36*a* and 36*b*. A front transverse support member or brace 38, extends between the front legs 36*a* and 36*b*, preferably in a substantially horizontal direction, to provide a brace or framework therebetween. The brace member 38 may also be of a tree member or twig, and preferably of alder, and may be secured to each of the front legs 36*a* and 36*b* by tenon and mortise joint.

The preferred type of lumber for all finished wood pieces and twigs described herein is alder, and a more preferred type of alder is that grown in the state of Oregon. However, it is apparent that other types of wood, such as hickory, maple, oak, or combinations of various types of wood, may be used to construct the twig furniture described herein. The terms "tree member," "twig" and "tree twig" are used interchangeably herein and in a generic sense to include various portions of a tree, such as, a limb portion and any associated branch portions of a larger tree, or a main trunk portion and any associated limb or branch portions of a smaller tree, for instance, a sapling.

In the preferred embodiment, a substantial portion of the tree bark which grew thereon is retained along the outer surface of the tree twig, and extraneous branches are removed therefrom, such as shown at 39 on the front support 30*a* in FIG. 1. Thus, the tree members may also be referred to as "natural wood" as opposed to the finished wood members, such as seat 20. Furthermore, portions of the tree bark may be removed from a twig, along with a portion of the wood beneath the bark, if desired, for example to form a smooth surface.

The rocker 20 has a pair of forked rear support members or rear supports 40*a* and 40*b* of a single forked twig or tree member. The rear supports 40*a* and 40*b* are mounted to the respective side walls 28*a* and 28*b* adjacent the rear wall 26 of seat 22, for example, by dowels 42*a* and 42*b*, which may be of alder (see FIGS. 1 and 2). The rear supports 40*a* and 40*b* extend upwardly from the seat 22 to form a pair of back support columns 44*a* and 44*b*. Each of the rear supports 40*a* and 40*b* comprises a portion of a single forked or branched tree member or twig, having a main portion 45*a* and 45*b*, respectively, which may have been a small tree trunk or a larger tree limb.

The rear supports 40*a* and 40*b* each have an auxiliary limb or branch portion 46*a* and 46*b*, respectively, which has grown outwardly from the respective main portions 45*a* and 45*b* at an acute angle, such as angle A shown in FIG. 2. The auxiliary limb portions 46*a* and 46*b*, together with the respective main portions 45*a* and 45*b*, form a pair of forked portions or rear legs 48*a* and 48*b* of the respective rear supports 40*a* and 40*b*. A particularly advantageous structural integrity is obtained by orienting the forked rear leg 48 with the auxiliary limb portion 46 extending rearwardly of the main portion 45.

The chair also includes a rear transverse support member or brace 49 extending between the main portions 45*a* and 45*b* beneath the seat 22, preferably in a substantially horizontal direction. The rear 49 brace may be of twig and attached to the main portions 45*a* and 45*b*, for example, by a tenon and mortise joint.

The chair 20 also includes a back portion 50 comprising upper and lower transverse support members 52 and 54, which each may be of a finished wood. The upper transverse back support 52 is preferably attached along a frontwardly facing portion near the upper end of each of the back support columns 44*a* and 44*b*, either by screws, doweling or other support methods (not shown). The lower transverse back support 54 is attached along a rearwardly facing portion of each of the columns 44*a* and 44*b* at a position substantially midway between the seat 22 and the upper support 52.

The back portion 50 also has a plurality of slat members, which may be of a finished wood, such as slat 56, attached to the seat rear wall 26, and the upper and lower transverse back supports 52 and 54. The slats may be attached to the seat and transverse back supports by a variety of means, and for instance, by screws as shown. To aid in the structural integrity of the back portion 50, and to provide an aesthetically pleasing appearance, a back support finishing member or strip 58 is attached over the lower portions of the slats 56 and to the seat rear wall 26. The finishing strip 58 may be of finished wood, and preferably of the same material as the slats 56.

The rocker 20 may also include a pair of arm members or arms 60*a* and 60*b* of a tree twig. The arms 60*a* and 60*b* extend from the respective arm support columns 34*a* and 34*b* to the respective back support columns 44*a* and 44*b*. Each arm 60 may be attached to the arm support column 34 and the back support column 44 by a tenon and mortise joint. Preferably the arms 60*a* and 60*b* have a portion of the tree bark and wood therebeneath removed from the twig to form armrests having a smooth, comfortable upper surface 62*a* and 62*b*, respectively.

Although the construction described thus far may be used to provide a suitable chair or bench, the illustrated rocker embodiment includes a pair of rockers 70*a* and 70*b* supporting the front and rear legs 36*a*, 36*b* and 48*a*, 48*b*, respectively. The front and rear legs may be secured to the rockers by tenon and mortise joints. To secure the front legs 36*a*, 36*b*, and the main and auxiliary limb portions 45*a*, 45*b* and 46*a*, 46*b*, respectively, with the respective rockers 70*a*, 70*b*, respective dowels 72*a*, 72*b*, 74*a*, 74*b* and 76*a*, 76*b*, may be used. The dowels 72, 74 and 76 may also be of alder.

FIGS. 5–8 illustrate a second embodiment of an article of twig furniture comprising a loveseat or bench, which may be configured as a loveseat rocker 100. There are several components of the loveseat rocker 100 which are similar to that of the rocker 20 shown in FIGS. 1–4. Such components in FIGS. 5–8 have item numbers which are increased by 100 over that shown for like components of the rocker 20.

The illustrated loveseat rocker 100 has a seat member or seat 180 which differs from the seat 22 of rocker 20. The seat 180 is configured for supporting two people side-by-side and has a pair of solid seating surfaces 182*a* and 182*b*, each sized to accommodate one person. It is apparent that the solid seat may, alternatively, include two seat portions arranged side-by-side (not shown) with each configured, for example, like seat member 22 of FIGS. 1–4. In this alternate embodiment, the two seat portions have adjoining sides along which the seat portions may be joined together. The seat portions may be joined by, for instance, two or more horizontally extending dowels (not shown) received by holes drilled into the adjoining sides of each seat portion.

The illustrated seat 180 also has a rear wall 184 with two convex curved portions 185*a* and 185*b*. The front and rear braces 138 and 149, respectively, are increased in length over their counterparts 38 and 49 in the rocker 20 to accommodate the wider loveseat configuration.

The loveseat rocker 100 has a back portion 190 modified over the back portion 50 of rocker 20. The back portion 190 has upper and lower transverse back supports 192 and 194. The upper support 192 has a pair of curved surfaces 195*a* and 195*b*, while the lower support 194 has a pair of curved surfaces 196*a* and 196*b*, with each pair of curved surfaces configured to accommodate two people seated side-by-side. The back portion 190 also includes a pair of back support finish members or strips 198*a* and 198*b* attached to the respective seat rear wall curved portions 184*a* and 184*b*. Alternatively, the finish strips 198*a* and 198*b* may be a single piece (not shown).

The rocker 20 and loveseat rocker 100 may be finished by a variety of coatings and oils known in the art. In the preferred embodiments which are constructed of alder, a tung oil finish is preferred to provide a smooth subtle glow to both the finished wood members and the bark-covered twig members.

Having illustrated and described the principles of my invention with respect to the preferred embodiments, it should be apparent to those skilled in the art that my invention may be modified in arrangement and detail without departing from such principles. For instance, other structural equivalents or other devices known to be interchangeable by those skilled in the art may be implemented. For example, other fastening means and other types of joints may be employed to secure together the various components of the articles of twig furniture described herein. Furthermore, suitable material substitutions and dimensional variations may be employed for the components of such articles of twig furniture. I claim all such modifications falling within the scope and spirit of the following claims.

I claim:

1. An article of furniture, comprising:

a solid seat member having an upper surface, a front portion, a rear wall, and a pair of sidewalls extending between the front portion and the rear wall;

a pair of front leg members extending downwardly from the pair of sidewalls adjacent the front portion of the seat member;

a pair of forked rear support members each having a main portion extending upwardly from the pair of sidewalls adjacent the rear wall of the seat member to form a pair of back support columns; and a back portion comprising a transverse back support extending between the pair of back support columns, and a plurality of slat members extending upwardly from the rear wall of the seat member to join the transverse support;

wherein each forked rear support member comprises only one branched tree member with the main portion having an auxiliary limb portion grown outwardly therefrom at an acute angle to form a fork portion, each fork portion extending downwardly from the seat member with the auxiliary limb portion extending rearwardly of the main portion, with the auxiliary limb portions of the forked rear support members being substantially parallel with the front leg members.

2. An article of furniture according to claim 1 wherein:

each of the pair of front leg members extends upwardly from the seat member to form a pair of arm support columns; and the article further includes a pair of arm members supported by the pair of arm support columns and the pair of back support columns.

3. An article of furniture according to claim 2 further including a pair of rocker members supported the pair of front leg members and the fork portion of the pair of support members, whereby the article of furniture comprises a rocker.

4. An article of furniture according to claim 2 wherein the seat member has first and second seat portions located side-by-side, and the back portion has first and second concave back portions located side-by-side and adjacent the respective first and second seat portions, whereby the article of furniture comprises a loveseat.

5. An article of furniture according to claim 4 further including a pair of rocker members supporting the pair of front leg members and the fork portion of the pair of support members, whereby the article of furniture comprises a loveseat rocker.

6. An article of furniture according to claim 1 wherein the forked rear support members are of alder.

7. A composite natural and finished wood loveseat, comprising:

a solid seat member for supporting two people seated side-by-side, the seat member also having a front portion, a rear wall, and a pair of sidewalls extending between the front portion and the rear wall;

a pair of front support members extending downwardly from the pair of sidewalls adjacent the front portion of the seat member to form a pair of front legs, and extending upwardly from the seat member to form a pair of arm support columns;

a front substantially horizontal support member extending between the pair of front legs;

a pair of forked rear support members each having a main portion extending upwardly from the pair of sidewalls adjacent the rear wall of the seat member to form a pair of back support columns;

a pair of arm members supported by the pair of arm support columns and the pair of back support columns;

a back portion for supporting two people seated side-by-side, the back portion comprising upper and lower transverse back supports, each extending between the pair of back support columns, with each transverse back support having first and second concave portions for receiving a plurality of slat members, with each slat member having a lower portion joined to the rear wall of the seat member;

wherein each of the pair of forked rear support members is of only one branched tree member with the main portion having an auxiliary limb portion grown outwardly therefrom at an acute angle to form a fork portion of each rear support member, the fork portion of the pair of rear support members extending downwardly as a rear leg portion with the auxiliary limb portion extending rearwardly of the main portion, with the auxiliary limb portions of the forked rear support members being substantially parallel with the front leg members; and a rear substantially horizontal support member extending between the rear leg portion of the pair of rear support members;

wherein the seat member, the upper and lower transverse back supports, and the plurality of slat members are each of a finished wood having a plurality of smooth surfaces; and wherein the pair of front support members, the pair of forked rear support members, the pair of arm members, and the front and rear substantially horizontal support members are each of a natural wood tree member having an outer surface retaining at least a portion of the tree bark which grew thereon.

8. A composite natural and finished wood loveseat according to claim 7 further comprising a pair of rocker members supporting the pair of front legs and the fork portion of the pair of rear support members, with the pair of rocker members each being of a finished wood having a plurality of smooth surfaces, whereby the loveseat comprises a loveseat rocker.

9. A composite natural and finished wood loveseat according to claim 7, wherein the forked rear support members are of alder.

10. An article of furniture, comprising: a seat member having an upper surface and a rear edge;

a back portion extending upwardly above the rear edge of the seat member; and two front legs and two back legs supporting the seat member, the two back legs each comprising a tree branch or trunk section having a main portion with an auxiliary limb portion extending therefrom upwardly at an acute angle relative to the tree roots when growing, the auxiliary limb portions being substantially parallel with the front legs, with the tree branch or trunk section inverted from the direction in which it grew with the main portion joined to the seat member and the auxiliary limb extending downwardly therefrom to support the article of furniture.

11. An article of furniture according to claim 10, wherein at least the back legs are of alder.

12. An article of furniture according to claim 10 wherein:

the main portions of the back legs extend upwardly above the seat member at a rearwardly sloping angle from the seat member to form back supports, with a transverse back support extending therebetween and having plural slats attached thereto to form the back portion;

two other legs extend upwardly above the seat member to each support respective arm members which are also attached to the main portions above the seat member; and two rocker members each supporting one of the main portions and the auxiliary limb portion extending therefrom, and one of the front legs.

13. An article of furniture according to claim 12 wherein the transverse back support has first and second concave portions located side-by-side for receiving the plural slats, and the article of furniture comprises a loveseat.

14. An article of furniture according to claim 12 wherein:

the seat member, the transverse back support, the plural slats, and the two rocker members are each of a finished wood having a plurality of smooth surfaces; and wherein the each of the legs and the arm members are of a natural wood tree member having an outer surface retaining at least a portion of the tree bark which grew thereon.

* * * * *